United States Patent [19]

Gane

[11] 4,128,186

[45] Dec. 5, 1978

[54] EASY OPEN END

[75] Inventor: Gordon R. Gane, Pleasanton, Calif.

[73] Assignee: Kaiser Aluminum & Chemical Corporation, Oakland, Calif.

[21] Appl. No.: 858,317

[22] Filed: Dec. 7, 1977

Related U.S. Application Data

[63] Continuation-in-part of Ser. No. 838,184, Sep. 30, 1977, abandoned.

[51] Int. Cl.[2] ..... B65D 41/32

[52] U.S. Cl. ..... 220/268

[58] Field of Search ..... 220/266–273; 222/541; 229/7 R

[56] References Cited

U.S. PATENT DOCUMENTS

| | | | |
|---|---|---|---|
| 3,958,717 | 5/1976 | Ellis | 220/268 |
| 3,972,445 | 8/1976 | Delenham | 220/268 |
| 3,982,657 | 9/1976 | Keller et al. | 220/268 |

*Primary Examiner*—George T. Hall

*Attorney, Agent, or Firm*—Paul E. Calrow; John S. Rhoades

[57] ABSTRACT

Improved sectionalized depressible opener tab for easy open containers wherein one of the sections can be relatively small as compared to the dimensions of the overall tab while being connected by an improved hinge arrangement to the remainder of the tab. This hinge arrangement permits either a simultaneous selective depression of multiple tab sections or depression of only one tab section to obtain initial separation of the tab from the container component with which the tab is associated and a controlled release of internal container pressure.

29 Claims, 11 Drawing Figures

EASY OPEN END

This application is a continuation-in-part of my prior application Ser. No. 838,184 filed Sept. 30, 1977 now abandoned.

BACKGROUND OF THE INVENTION

The instant invention relates to easy open container components such as container end closure members and the like. More particularly it is concerned with providing an improved depressible combination pressure release, vent and pouring opening tab for container components such as can end closures that includes multiple tab sections such as primary and secondary tab sections. The secondary tab section is connected to the primary section by an improved weakened hinge portion. This hinge portion facilitates either the simultaneous selective depression of the various tab sections or only the secondary tab section in order to obtain an initial separation of the tab from the container component with which it is associated and to controllably relieve the internal pressure generated by the contents of the container within the container.

Significant problems involved in the construction and use of depressible or push button tabs for beer and effervescent beverage containers, and the like, concern the controlled relief of internal pressures and the venting of the container's interior to the atmosphere during initial opening of the container equipped with such tabs in order to avoid undesirable outward spraying, splattering and foaming of the container's contents, etc.

Past efforts to avoid the aforesaid problems have included the use of a pair of differentially sized openings in a can top, each of which was covered by a separate depressible push button. The smaller opening and its associated push button provided the pressure release and atmospheric vent opening means and the larger opening provided the primary pouring opening. The smaller push button was adapted to be opened first and because of its smaller size required less force. This type of prior art push button or depressible opener tab container end is illustrated, for example, in U.S. Pat. Nos. 3,902,627; 3,958,717; 3,972,445; 3,886,881; 4,033,275; U.S. Pat. Nos. D. 226,171 and 233,137; British patent specifications Nos. 1,357,468 of June 19, 1954 and 1,407,806 of Sept. 5, 1975 and Australian Pat. No. 475,951.

It has been further suggested that such prior art small pressure release and vent openings be incorporated in the principal of large depressible tab structure of an easy open can end. Prior art patents illustrating this type of can end construction, for example, include U.S. Pat. Nos. 3,741,432 and 3,794,206 as well as German Offenlegungsschrift No. 2,421,314 published Nov. 14, 1974 and British specification No. 1,444,470 of July 28, 1976. In these instances the smaller depressible tab was connected to the main or larger depressible tab of which it forms a part by a simple hinge arrangement.

Another approach to solving the pressure relief and venting problems of easy open cans for beer and effervescent beverages is contained in the patent application of John S. Rhoades, Ser. No. 830,970, filed Sept. 6, 1977, in which the proposal is made to equip the nose portion of a depressible easy open container tab with a unique pressure release and venting notch means.

SUMMARY OF THE INVENTION

The instant depressible tab constitutes an improvement over the aforementioned prior art easy open depressible tabs including that disclosed in the aforementioned patent application by forming the tab into primary and secondary sections. The secondary tab section is formed integrally with and is connected to the primary tab section by way of an improved weakened hinge arrangement. In one embodiment of the invention, this weakened hinge arrangement facilitates the simultaneous and selective depression of the various tab sections relative to the container or end closure member to initiate the separation of the overall tab from the portion of the container with which it is associated while at the same time controllably relieving the internal pressures generated by the contents of the can or container to avoid undesirable spraying, frothing, etc.

A further advantage is gained in the development of the instant invention when the secondary tab section is made with a smaller peripheral dimension than that of the primary tab section because the smaller tab section alone can then be used, if desired, to initiate tab and container separation because of the tab force application advantage involved. In other words, the smaller the tab section the less force is required to effect initial tab section depression and initial tab and sealed panel separation.

A further preferred embodiment of the invention, therefore, contemplates that one of the tab sections or segments be smaller than the other tab section. Thus, regardless of how the tab is initially contacted or depressed as by the simultaneous depression or more than one tab section and the pivoting of the same about a common weakened hinge like or by the initial depression and pivoting of the small tab section alone relative to the overall tab, a controlled release of internal pressure will still be accomplished. In other words, it is an advantage of the instant invention that the tab is so structured that it can be manipulated in a variety of ways to effect a controlled opening of a container.

In one embodiment of the invention the secondary tab section may also be advantageously notched to enhance and improve its function of controllably relieving the internal container pressures during the initial opening of the can provided with the tab.

The depressible tab of the instant invention constitutes, in addition, an improvement over the single depressible tab structures of U.S. Pat. Nos. 2,176,898; 3,912,113; 3,982,657; 3,779,417; 3,980,034; 2,261,117; 3,905,513; 1,878,677; 3,881,437 and 3,843,011 as well as the other depressible tab developments of U.S. Pat. Nos. 3,410,436; 3,760,752; 3,886,199; 3,334,775; 4,006,700; 3,286,874; 3,931,909; 3,902,627; 4,018,178; 4,003,495; 4,043,481 and No. D. 208,591.

The preferred embodiment of the invention further comtemplates that during manufacture the depressible tab would be completely severed from the end closure panel per se or the portion of the container with which it is associated except in the area of the main tab hinge. This will then permit the tab to be advantageously overlapped and locked in position by the end closure panel either by virtue of flattening and expanding the peripheral edges of the tab such as in the manner disclosed in U.S. Pat. No. 4,033,275 or by stretching the portions of the end closure panel immediately surrounding the tab opening above and about the tab such as in the fashion disclosed and discussed in U.S. Pat. Nos. 3,759,206 and 3,931,909 to obtain the desired selected overlapping of the tab by the end closure panel except for the main tab hinge portion. After the aforesaid overlapping of tab and panel has been completed the line of severance between the end closure panel or container component and the tab is subsequently sealed by the application of an appropriate flexible plastic sealing material in a manner noted, for example, U.S. Pat. No. 3,931,909 such as by means of a plastisol material sold uner the designation "Plastisol 911" by the Dewey and Almy Chemical Division of W. R. Grace and Company of San Leandro, Calif.

It is preferred that the plastisol sealant material be applied in the manner of a continuous ring which can include a crossbar or chord-like segment depending on the configuration of the tab whereby the main hinge portion of the tab that connects the tab to the end closure panel as well as the weakened hinge portion between the primary and secondary tab sections will all be covered with the sealant. This provides an arrangement wherein the sealant can advantageously act as discussed in U.S. Pat. No. 3,972,445 as supplemental connecting hinges.

In the ensuing discussion it is to be understood that the terms "container component", "closure member" and "end closure" as used throughout the specification and claims are meant to include container components and closures made from various types of appropriate materials such as aluminum and its alloys, and other metals such as steel and tin plate, which are suitable for manufacturing the container components and closures. These terms further encompass container components and closures made of the aforesaid metals and provided with relatively thin plastic films and coatings well known in the art and customarily used to protect the component and closure metal against the contents of the containers and vice versa as well as container closures of other than circular configurations. Further, while the discussion of the tab will be concerned primarily with circular tabs, it is to be understood that the tabs can have other configurations; e.g., the tabs can be oblong, elliptical, rectangular, triangular, etc.

BRIEF DESCRIPTION OF THE DRAWINGS

FIG. 4(*a*) is a view similar to FIG. 4 and illustrates a preferred arrangement for initially contacting and simultaneously depressing both tab sections to initiate tab and container component separation;

DETAILED DESCRIPTION

Figure 1:
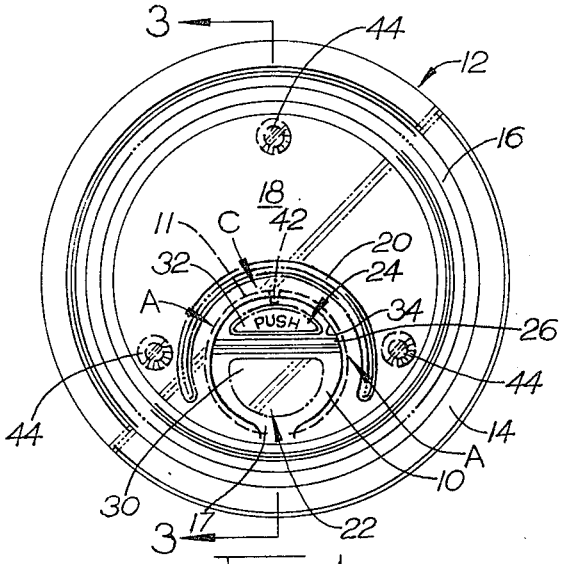
FIG. 1 is a top plan view of a container end closure provided with the improved sectionalized depressible tab of the instant invention and with the main tab hinge being located adjacent the counter sink portion of the container end closure.

With further reference to the drawings and, in particular, FIGS. 1 through 4, the depressible tab 10 of the instant invention can be advantageously incorporated in a can end closure 12 that is provided with the standard outer peripheral rim 14 and a reinforcing rib or counter sink 16. End closure 12 includes a main panel section or portion 18, and panel section 18 may be reinforced adjacent the depressible tab 10 with the arcuate embossment 20. Embossment 20 projects sufficiently upwardly above the top surfaces of panel 18 and tab 10 in the manner illustrated in the drawings whereby it can serve as a protective embossment for tab 10 even when the end closure 12 is locked seamed to an open can body by way of rim 24. In a preferred embodiment of the invention, embossment 20 extends for more than one-half or for the major portion of and in slightly spaced relation to the outer periphery 11 of tab 10.

Depressible tab 10 which is completely severed from panel 18 except for the primary hinge portion 17 is comprised of the main or primary section 22 and the secondary or forward section 24. An improved secondary weakened hinge portion 26 connects the primary and secondary tab portions 22 and 24 and this hinge portion 26 in a preferred embodiment of the invention is selectively weakened by means of a preferably linear score 28 of a few thousands of an inch depth located on the top surface of panel 18. In certain preferred embodiments of the invention score line 28 can be approximately V-shaped in a cross-section and can extend along with hinge 26 substantially fully across or when the tab is circular or arcuate in chord-like fashion across the tab 10. Closure member 12 can be made from a readily ductile and workable aluminum alloy of the appropriate hardness or temper such as an aluminum alloy presently designated by the American Aluminum Association as aluminum alloy No. 5182 having a temper between ¾ and full hard. The closure member can have a gauge on the order of 0.013 inch and the depth of score 28 can be on the order of 0.008 inch.

As will be further observed by reference to FIGS. 1 through 4(*a*) the primary and secondary tab segments 22 and 24 are advantageously provided with the finger engaging embossments or buttons 30 and 32, respectively. As noted, tab 10 is connected to the main panel 18 by a primary hinge section 17 of the appropriate size with section 17 also being integral with panel 18. After primary and secondary tab sections 22 and 24 have been fabricated, the overall tab can be advantageously overlapped and locked into position relative to the end closure panel 18 either by virtue of flattening and expanding at least the peripheral portions of the tab in the manner disclosed in U.S. Pat. Nos. 4,033,275 and 2,261,117 or by stretch-forming the panel portions 34 surrounding the end closure opening 36 so as to decrease the size of opening 36 relative to the tab 10 in the manner discussed in U.S. Pat. No. 3,931,909 to form a panel and tab overlap.

In any event, regardless of how the desired and selected overlapping of tab 10 and panel 18 is effected once it is completed the line of severance between the end closure panel 18 and the peripheral portions of the tab can be sealed by the application of an appropriate plastic sealant material 38.

Figure 2:
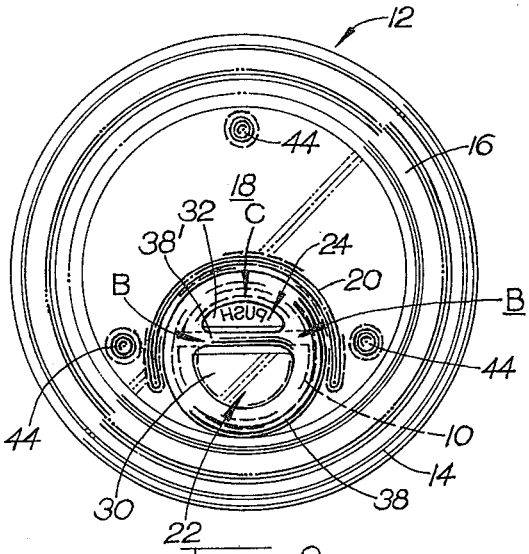
FIG. 2 is a bottom plan view of the underside of the end closure of FIG. 1 and illustrates the manner in which the sealant material is applied to the push button depressible tab and the various hinge portions thereof for sealing the tab to the end closure member, etc.
Figure 3:
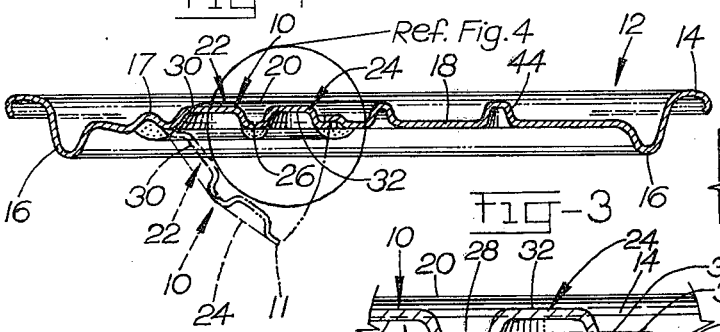
FIG. 3 is an enlarged cross-sectional view taken generally along the line 3—3 of FIG. 1, and with the positions assumed by the tab components as a consequence of using a preferred arrangement for depressing and opening the tab being shown in dotted lines.

In this connection, and as illustrated in FIG. 2, the sealant plastic material 38 can be advantageously applied in such a fashion in the form of a continuous ring of the appropriate thickness and width along with a sealant sector or crossbar 38' that the plastic material will cover not only the severed and overlapped portions of the panel 18 and tab 10, but the main hinge portion 17 and weakened hinge portion 26 as well. Coverage of these hinge areas as noted provides for a supplemental connection of the tab parts to each other and main panel 18 and helps prevent detachment of the hinged parts from each other and the tab panel if for any reason fracture of the metal occurs in the same areas such as by abusive overbending of the metal of the tab in the aforementioned hinge areas by the container user.

Figure 4A:
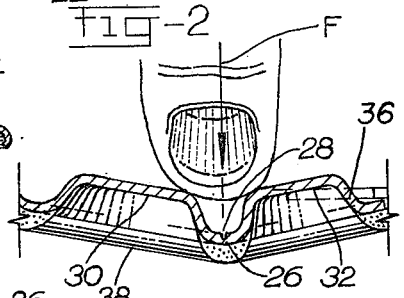
FIG. 4 is an enlarged fragmentary sectional view taken generally within the circumscribing reference circle of FIG. 3 with parts removed and illustrates how the secondary tab section can be the part of the tab that is initially depressed, said section also being provided with a pressure release notch.
Figure 4:
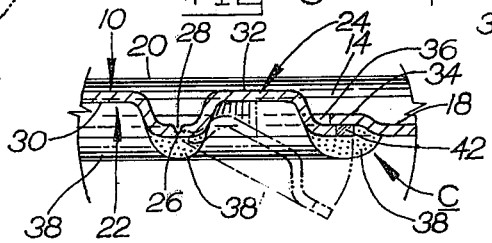
Figure 5:
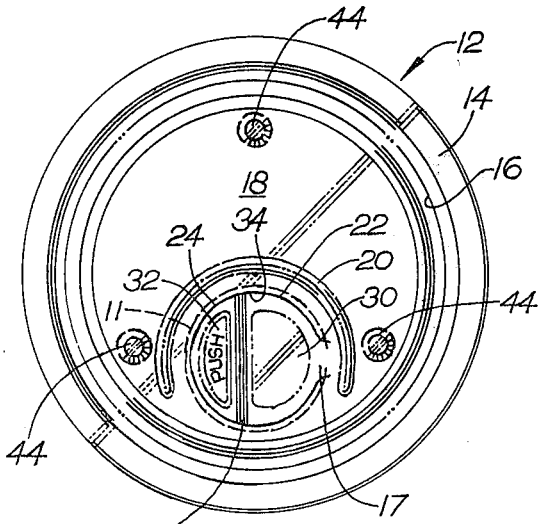
FIG. 5 is a top plan view similar to FIG. 1 of a modified container end closure provided with the improved depressible tab on the instant invention wherein the main hinge portion of the tab has been rotated approximately 90° counter clockwise from that illustrated in FIG. 1.

If desired, and as noted particularly in FIGS. 1 and 4, the secondary tab section 24 can be notched at 42 in the manner discussed in copending application Ser. No. 830,970 of John S. Rhoades to facilitate the controlled release of internal pressures generated by the contents of the can with which the tab 10 and container end closure 12 are associated.

The main panel 18 can be equipped with the additional frustro-conical raised portions or embossments 44, which along with embossed rib 20 serve to protect the push button tab 10 against accidental or inadvertent depression and opening at the time the peripheral rim 14 of an end closure provided with such a tab is lock-seamed by the customery equipment to the open end of a container as well as during other container end handling and stacking operation.

Figure 6:
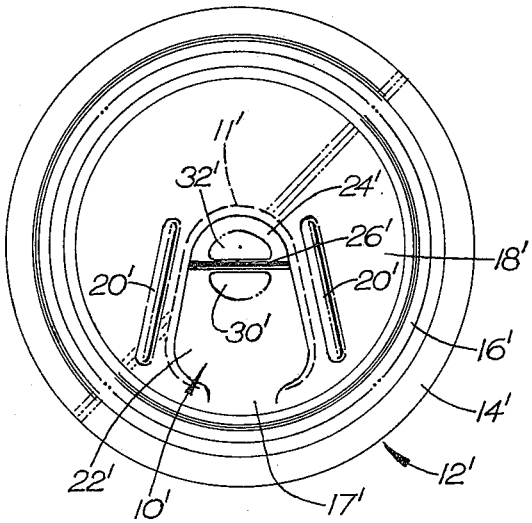
FIG. 6 is a top plan view of a container end closure with a modified tab structure incorporating the features of the instant invention.

A slightly modified tab structure embodying the same advantageous features of the tab of FIGS. 1–5 is shown in FIG. 6 wherein prime reference numerals and letters are employed to designate like or similar elements. It is also to be understood that a sealant material (not shown) is to be applied to the underside of panel 18' of end closure 12' in the same fashion as is described relative to end closure 12 and illustrated in FIGS. 2 and 3.

A preferred sequence of steps to be followed in uncovering opening 36 by depressing tab 10 will now be described with reference particularly to FIG. 1–4(*a*). The operator first places his or her finger F; e.g., a thumb in a bridging fashion atop both embossments 30 and 32 for the primary and secondary tab sections 22 and 24 and then simultaneously applies downwardly directed forces to both sections. This application of force results in a collapse or bending of tab 10 about weakened hinge 26 in the manner noted in FIG. 4(*a*) until a sufficient fracturing of the stretched plastic sealant 38 takes place at one or both ends A of hinge 26 to produce internal pressure release vents in the sealant adjacent such ends A.

When one or more pressure release vents are formed in one or more of the area sectors B of the plastic material on the underside of panel 18 as indicated in FIG. 2 and the interior pressure controllably released the continued force application will result in the further and full separation of the overall tab 10 from panel 18 except for hinge portion 17 and a pivotal inward movement of the entire tab 10 as a unit about hinge portion 17 to the extent desired. This is all indicated by way of example in dotted lines in FIG. 3. It is to be understood that a similar type of tab manipulation can take place as regards the tab 10' of the easy open end of FIG. 6.

Although some metal bending may occur at the score 28 during tab opening, it normally will not result in metal fracture unless excessive force is used in which case the sealant 38' covering hinge area 26 will take over as a supplemental hinge. A slight bending of hinge 26 on the other hand will advantageously help to form small metal creases at the ends of hinge 26 that penetrate the plastic sealant and help fracture the same in the fashion desired so as to effect controlled pressure relief of the container's contents.

If, as viewed in FIG. 4, the alternate method of uncovering opening 36 is employed wherein the smaller secondary tab section 24 is deliberately first depressed independently of tab section 22 to obtain initial tab and panel separation and pressure relief the following operational sequence will normally occur. The operator first applies a force by way of his or her finger to the embossment 32 of secondary section 24 causing the stretching of plastic 38 in the area C until a sufficient fracturing of the plastic sealant occurs to produce the desired pressure release and vent opening. It is to be noted that the controlled release of pressure is enhanced here and outward spraying of the container contents avoided since the operator's finger will normally provide a protective cover for the opening made in the plastic sealant as well as in the case of where the operator covers the weakened hinge 26 area during the first mentioned method of tab and panel separation illustrated in FIGS. 3 and 4(*a*).

Once the initial separation of tab 10 and panel 18 takes place along with the desired pressure relief and venting the continued downward force applied by the operator can be transferred to the primary section 22 of tab 10 to effect a pivotal inward movement of the tab 10 as a whole to the extent desired about hinge 17.

In a further preferred embodiment of the invention the peripheral extent of the small tab sections 24 and 24' can comprise between one-fourth and one-third the entire outer peripheral part 11 of the tab that is completely severed as a unit from and sealed by plastic material 38 to the end panel 18. Thus, the part of the opening 36 covered or closed by sections 24 or 24' will be small in comparison both to the part of opening 36 closed by tab sections 22 or 22' as well as the entire opening 36 closed by both primary and secondary tab sections considered together. This provides for a tab force application advantage in depressing the small tab section 24 first about weakened hinge line 26 as previously noted along with a controlled release of the internal pressure of the container provided with the tab.

If desired, the area on panel 18 that becomes hinge 17 in the final end closure can be somewhat bulged in the manner indicated in U.S. Pat. No. 3,980,034 during the initial steps of tab fabrication and tab and panel severance. Thereafter, the bulged area is flattened or collapsed and, upon flattening the forward tab section 24, can be forced forward and additionally overlapped by panel 18.

Figure 7:
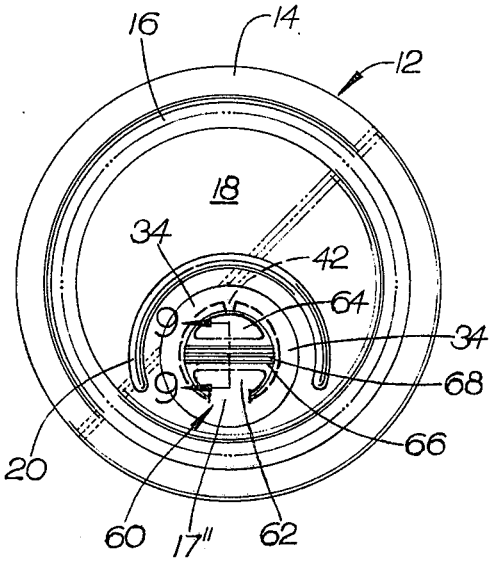
FIGS. 7 and 8 are top plan views of further container end closures provided with modified tab structures in which the features of the instant invention are incorporated.
Figure 8:
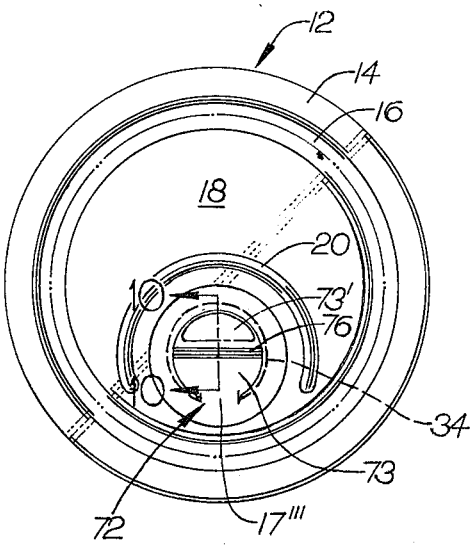
Figure 9:
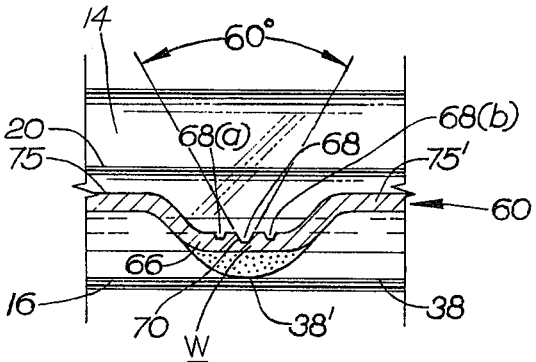
FIGS. 9 and 10 are enlarged fragmentary cross-sectional views taken along lines 9 and 10 of FIGS. 7 and 8, respectively.

Additional modifications of the instant invention are illustrated in FIGS 7–10. FIGS. 7 and 9 disclose a segmented tab 60 made up of primary and secondary tab sections 62 and 64 joined by a secondary weakened chord-like hinge 66 provided with a main linear score 68 and spaced linear scores 68(*a*) and 68(*b*) of less depth than score 68 by a few thousands of an inch.

The secondary or auxiliary score lines 68(*a*) and 68(*b*) are advantageously used as anti-fracture score lines in the same fashion as indicated in U.S. Patent and Trademark Office Defensive Publication No. 793,231 of L. G. Dunn published Sept. 16, 1969. Thus, score lines may be formed along preselected lengths or for the full length of main score line 68 and are preferably parallel to line 68. These secondary score lines are formed as noted in the aforesaid publication by secondary die or indentor scoring ribs when the primary scoring rib of a die causes the metal in the area of score 68 to be displaced and extruded outwardly until trapped between the primary and indentor scoring ribs of the tab forming dies thereby preventing fracture of residual web W in hinge sector 66.

The tab 60 can be provided with a pressure relieving notch 42 and it is severed from, hinged and sealed to main panel 18 in the same fashion as the tab 10 of FIGS. 1–5. Tab 60 is likewise adapted to be manipulated and opened in the same fashion as tab 10 of FIGS. 1–5. The use of multiple score lines 68, 68(*a*) and 68(*b*) and a somewhat wide main score 68 that can have a width at the top thereof that approximates the original thickness of the metal in panel 18 provides tab 60 with a somewhat weaker secondary hinge 66 than hinge 28 of tab 10 and one which is readily susceptible to mainpulation and bending with a small amount of force.

In a preferred embodiment of the invention, the angles of inclination of sidewalls 70 of main score 68 form a 60° arc. The width of score 68 at the top can range between 0.012 inch to 0.016 inch when the initial thickness of the panel 18 approximates 0.013 inch, while the depth of score 68 can be on the order of 0.008 inch to 0.0010 inch leaving the residual web W with a thickness on the order of 0.003 inch to 0.005 inch.

Figure 10:
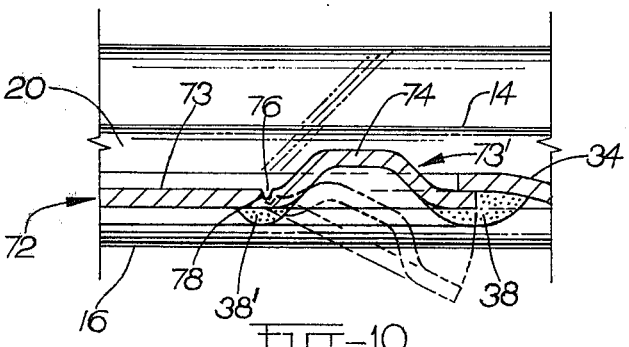

The tab 72 of FIGS. 8 and 10 differs from tab 10 of FIGS. 1–5 and tab 60 of FIGS. 7 and 9 primarily in the use of a flat or planar top for primary tab segment 73 connected to secondary tab segment 73' by means of the weakened web 76. Web 76 can be weakened by a single score line 78 or by a main score line and additional score lines similar to the score lines 68(*a*) and 68(*b*) of FIGS. 7 and 9.

Raised portions of the different segments of the tabs 60 and 72 such as raised portion 74 of secondary tab segment 73' and portions 75 and 75' of tab 60 can be of a smaller height than the embossed or raised portions of the tab segments for tab 10. Finally the tab overlapping panel portions 34 for the various tabs 60 and 72 can be increased in size so as to both emerge with and somewhat encircle the hinge portions 17'' and 17''' for tabs 60 and 72.

Advantageous embodiments of the invention have been disclosed and described. It is obvious that various changes and modifications may be made therein without departing from the spirit and scope thereof as defined in the appended claims wherein:

What is claimed is:

1. An easy open container component comprised of panel means and a depressible tab provided with a primary section and a primary hinge portion formed integrally with said primary tab section and the panel means, said tab further including a secondary section formed integrally with the primary tab section and a selectively weakened secondary hinge portion that runs substantially fully across and connects the secondary tab section to said primary tab section, said primary and secondary tab sections being fully severed from and selectively overlapped by said panel means except in the area of said primary hinge portion, sealant material covering the underside of said panel means at least in the area of severance of said primary and secondary tab sections for effecting a seal between said severed panel means and tab sections whereby the operator can apply a force either simultaneously to both tab sections or only to the secondary tab section in order to obtain an initial separation of the panel means and tab and a subsequent pivoting of the entire tab as a unit about the primary hinge portion to the extent desired.

2. The container component of claim 1 wherein the primary hinge portion is located adjacent the outer peripheral portion of the panel means.

3. The container component of claim 1 wherein the sealant material also covers the section of the underside of the panel means that comprises the weakened hinge portion.

4. The container component of claim 1 wherein the secondary hinge portion is weakened by at least one score line.

5. The container component of claim 4 wherein the score line runs completely across the top side of the tab.

6. The container component of claim 1 wherein the secondary tab section is provided with finger engageable embossment means.

7. The container component of claim 1 wherein the sealant material also covers the underside of the panel means in the area of the primary hinge portion.

8. The container component of claim 1 wherein the secondary tab section is provided with a pressure release notch means.

9. The container component of claim 1 wherein the secondary tab section is of a smaller peripheral dimension than that of the primary tab section.

10. An easy open container end closure comprised of a main panel encompassed by a rim and a counter sink portion together with a depressible tab that includes a primary section and primary hinge portion formed integrally with the main panel and said primary tab section, the tab further including a secondary section formed integrally with but of a smaller size than the primary tab section and a secondary weakened hinge portion that runs substantially fully across and connects said secondary tab section to said primary tab section, said primary and secondary tab sections being fully severed from and selectively overlapped by said panel except in the area of said primary hinge portion, sealant material covering the underside of said panel at least in the area of severance of said primary and secondary tab sections for effecting a seal between said panel and tab sections whereby the container user can apply a force either simultaneously to both tab sections or only to the secondary tab section in order to obtain an initial separation of the panel and tab and a subsequent pivoting of the entire tab as a unit about the primary hinge portion to the extent desired.

11. The end closure of claim 10 wherein the primary hinge portion is located adjacent the outer peripheral portion of the panel.

12. The end closure of claim 10 wherein the sealant material also covers the underside of the panel in the area of the weakened hinge portion.

13. The end closure of claim 10 wherein the secondary hinge portion is weakened by at least one score line.

14. The end closure of claim 13 wherein the score line runs completely across the top of the tab.

15. The end closure of claim 10 wherein the secondary tab section is provided with finger engageable embossment means.

16. The end closure of claim 10 wherein the sealant material also covers the underside of the panel in the area of the primary hinge portion.

17. The end closure of claim 10 wherein the secondary tab section is provided with a pressure release notch means.

18. The end closure of claim 13 wherein the sealant material also covers the underside of the panel in the area of the weakened hinge and on a side of the panel opposite from that containing the score line.

19. The end closure of claim 13 wherein the closure panel has a thickness on the order of 0.013 inch and the score line has a depth on the order of 0.008 inch.

20. The end closure of claim 18 wherein the closure panel has a thickness on the order of 0.013 inch and the score line has a depth on the order of 0.008 inch.

21. The end closure of claim 12 wherein the smaller sized secondary tab section comprises between one-fourth and one-third the entire outer peripheral part of the tab that is completely severed as a unit from and sealed by the sealant material to the panel.

22. The container component of claim 1 wherein said weakened hinge portion is provided with a plurality of score lines.

23. The container component of claim 22 wherein one of the score lines has a different depth from that of another score line.

24. The container component of claim 22 wherein the depressible tab is arcuate and the weakened hinge portion and score lines extend chord-like across the tab.

25. The container component of claim 22 wherein the score lines are located in spaced parallel relation.

26. The end closure of claim 10 wherein said weakened hinge portion is provided with a plurality of score lines.

27. The end closure of claim 26 wherein one of the score lines has a different depth from that of another score line.

28. The end closure of claim 26 wherein the depressible tab is arcuate and the weakened hinge portion and score lines extend chord-like across the tab.

29. The end closure of claim 26 wherein the score lines are located in spaced parallel relation.

* * * * *

UNITED STATES PATENT AND TRADEMARK OFFICE

CERTIFICATE OF CORRECTION

PATENT NO. : 4,128,186

DATED : December 5, 1978

INVENTOR(S) : Gordon R. Gane

It is certified that error appears in the above-identified patent and that said Letters Patent are hereby corrected as shown below:

Column 1, line 52, "principal of large" should be --principal or large--

Column 2, line 35, "hinge like" should be --hinge line--

Column 2, line 57, "comtemplates" should be --contemplates--

Column 3, line 8, "example, U. S." should be --example, in U. S.--

Column 3, line 9, "uner" should be --under--

Column 4, line 34, "rim 24" should be --rim 14--

Column 7, line 36, "mainpulation" should be --manipulation--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*